United States Patent [19]

Maloney

[11] Patent Number: 4,871,118

[45] Date of Patent: Oct. 3, 1989

[54] MACHINE FOR DENSIFYING PLASTIC CONTAINERS AND THE LIKE

[75] Inventor: Daniel T. Maloney, Cahokia, Ill.

[73] Assignee: Simplicity Engineering, Inc., Durand, Mich.

[21] Appl. No.: 266,187

[22] Filed: Nov. 2, 1988

[51] Int. Cl.[4] ..... B02C 19/14

[52] U.S. Cl. ..... 241/99; 241/225; 241/243

[58] Field of Search ..... 241/166, 167, 243, 292.1, 241/222, 224, 225, 99

[56] References Cited

U.S. PATENT DOCUMENTS

| | | | |
|---|---|---|---|
| 3,229,921 | 1/1966 | Hess et al. . | |
| 3,545,689 | 12/1970 | Luscombe . | |
| 4,039,150 | 8/1977 | Ivarsson . | |
| 4,098,181 | 7/1978 | Schultz . | |
| 4,153,206 | 5/1979 | Haefner et al. . | |
| 4,285,426 | 8/1981 | Cahill . | |
| 4,573,641 | 3/1986 | DeWoolfson et al. . | |
| 4,600,158 | 7/1986 | Matoba | 241/243 |
| 4,669,673 | 6/1987 | Lodovico et al. . | |
| 4,678,126 | 7/1987 | Prentice et al. | 241/243 X |

FOREIGN PATENT DOCUMENTS

| | | | |
|---|---|---|---|
| 74340 | 2/1918 | Austria | 241/225 |
| 205844 | 7/1939 | Switzerland | 241/225 |
| 1366212 | 1/1988 | U.S.S.R. | 241/243 |

*Primary Examiner*—Mark Rosenbaum
*Attorney, Agent, or Firm*—Grace J. Fishel

[57] ABSTRACT

A machine for densifying plastic containers, such as recyclable FET bottles, includes a feeder and a shredder. The feeder includes a paddle wheel with radial vanes for feeding the containers into the inlet of the shredder and blocking their return. A scraper is provided adjacent the outlet of the feeder for dislodging any material wedged in the pocket formed between adjacent vanes and preventing its return into the inlet of the feeder. The shredder includes intermeshing rotary shredder elements and stationary shredder elements, the cutting surfaces of which slope with respect to each other to provide a scissoring action. In a preferred form, each rotary shredder element includes a sharpened outer tip which projects in the direction of rotation for starting a tear in the container undergoing reduction. Each stationary shredder element also includes a sharpened outer tip which projects opposite the direction of rotation for retaining larger pieces of material in the shredder for further shredding. A scraper is provided adjacent the outlet of the feeder for dislodging material caught on the rotary shredder elements and directing it into the outlet of the shredder.

7 Claims, 4 Drawing Sheets

MACHINE FOR DENSIFYING PLASTIC CONTAINERS AND THE LIKE

BACKGROUND OF THE INVENTION

Rigid plastic containers are in common use for household products. Food products such as soda, milk, fruit juice, syrup, peanut butter, salad dressing, mayonnaise and other food products are commonly packaged in rigid plastic containers. Rigid plastic containers also find wide use in packaging of other household products such as soap, bleach, starch, motor oil and so forth and in the packaging of cosmetics such as shampoos, hair conditioners, skin lotions and the like.

In order to provide a suitable packaging for the many commodities purchased by the general public, a plastic container must be sufficiently rigid to be handled on conventional high speed filling and capping lines and to be handled during shipment and by the ultimate consumer during use. If the product is under pressure as in the case of carbonated beverages, it must be sufficiently strong to contain the product.

Rigid plastic containers which meet the demands of suitable packaging present a serious disposal problem because they cannot be easily densified for disposal or for recycling. Some of the bottles found in trash are capped such that they cannot be compressed with a baler and when they are ground in an ordinary shredder tend to bounce out of the machine or deform sufficiently to pass through the mill without being reduced.

In view of the above, there is a need for an effective machine for densifying rigid plastic containers. It is therefore an object of the present invention to provide such a machine. Other objects and features of the invention will be in part apparent and in part pointed out hereinafter.

The invention accordingly comprises the constructions hereinafter described and their equivalents, the scope of the invention being indicated in the following claims.

SUMMARY OF THE INVENTION

The present invention relates to a machine for densifying plastic containers and the like including a feeder and a shredder. The feeder includes a paddle wheel with radial vanes for feeding the containers into the inlet of the shredder and blocking their return. A scraper is provided adjacent the outlet of the feeder for dislodging any material wedged in the pocket formed between adjacent vanes and preventing its return into the inlet of the feeder. The shredder includes intermeshing rotary shredder elements and stationary shredder elements, the cutting surfaces of which slope with respect to each other to provide a scissoring action. In a preferred form, each rotary shredder element includes a sharpened outer tip which projects in the direction of rotation for starting a tear in the container undergoing reduction. Each stationary shredder element also includes a sharpened outer tip which projects opposite the direction of rotation for retaining larger pieces of material in the shredder for further shredding. A scraper is provided adjacent the outlet of the feeder for dislodging material caught on the rotary shredder elements and directing it into the outlet of the shredder. For purposes of economy and ease of maintenance, the feeder and the shredder are preferably powered by a common power source.

BRIEF DESCRIPTION OF THE DRAWINGS

In the accompanying drawings, in which one of various possible embodiments of the invention is illustrated, corresponding reference characters refer to corresponding parts throughout the several views of the drawings and in which.

DETAILED DESCRIPTION OF THE INVENTION

Figure 1:
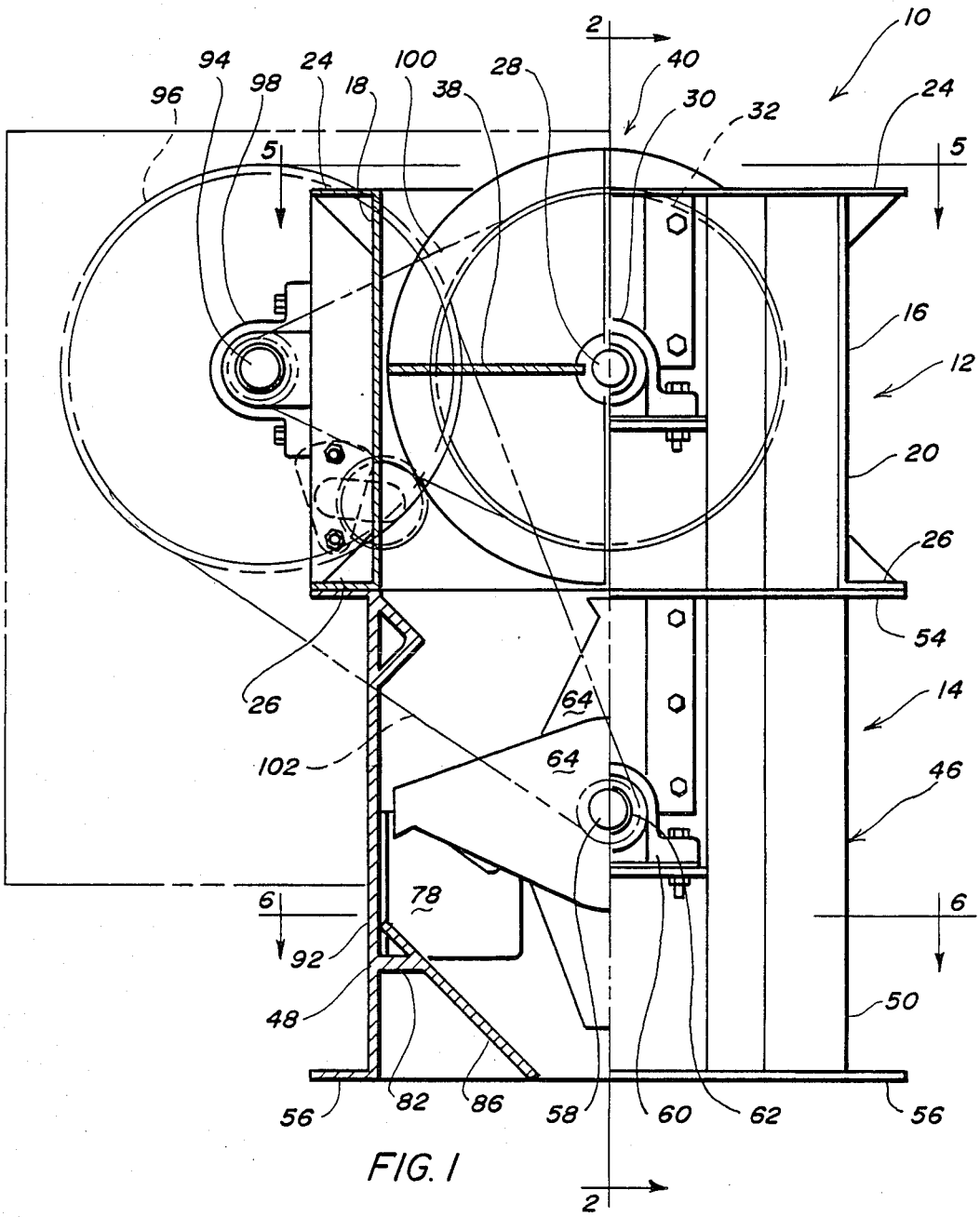
FIG. 1 is a side elevational view, partly in section, of a machine for densifying rigid plastic containers including a feeder for delivering the containers into a shredder for shredding them.
Figure 2:
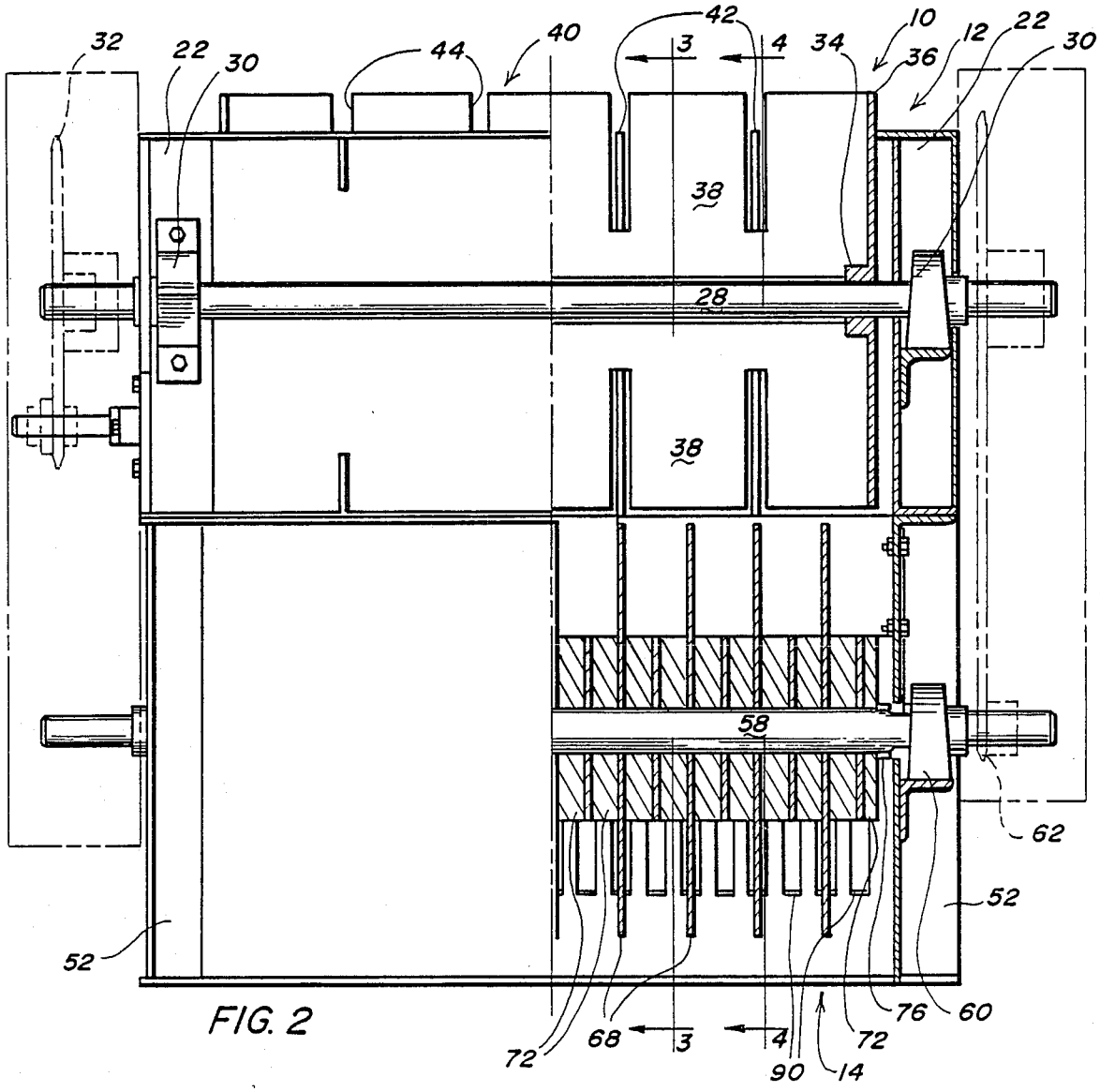
FIG. 2 is a sectional view taken along line 2—2 in FIG. 1.

Referring to the drawings more particularly by reference character, a machine 10 is provided in accordance with the present invention having a feeder 12 for delivering rigid plastic containers into a shredder 14 for densifying them. Feeder 12 comprises an enclosure 16 which is open at its upper and lower ends to provide an inlet for receiving the containers and an outlet for delivering them into shredder 14, respectively. As illustrated in the drawings, enclosure 16 includes a front and rear panel, 18 and 20, respectively, joined by side panels 22. Outwardly projecting top and bottom flanges 24 and 26 are provided on enclosure 16 for attachment optionally to a hopper (not shown) and to shredder 14, respectively.

A rotatable shaft 28 spanning enclosure 16 and extending through side panels 22 is rotatably journaled in bearing blocks 30 which are supported by the side panels. The driven end of shaft 28 outside enclosure 16 is keyed to a large pulley 32 for use as described hereinafter and a pair of hubs 34 are keyed to shaft 28 within enclosure 16 adjacent side panels 22. A pair of disks 36 are attached to the outboard edges of hubs 34 and provide a framework for attachment of a plurality of radial vanes 38 forming a paddle wheel 40 for receiving rigid plastic containers fed into the inlet of enclosure 16 and forcing them through the outlet into shredder 14. Vanes 38 are preferably four in number to maximize the size of the pocket formed between adjacent vanes while effectively preventing material from being ejected up through feeder 12 between paddle wheel 40 and the sidewalls of enclosure 16. For this purpose, vanes 38 are dimensioned of a width such that they extend from shaft 28 and in horizontal position approach front and rear panels 18 and 20 closely and of a length such that disks 36 are close to side panels 22.

Figure 3:
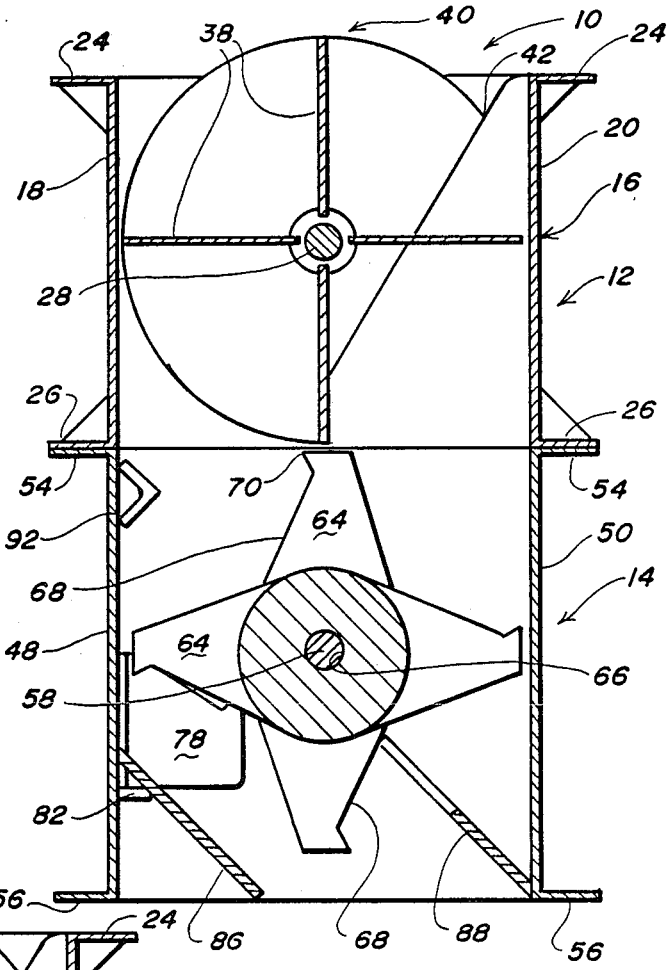
FIG. 3 is taken along line 3—3 in FIG. 2.
Figure 4:
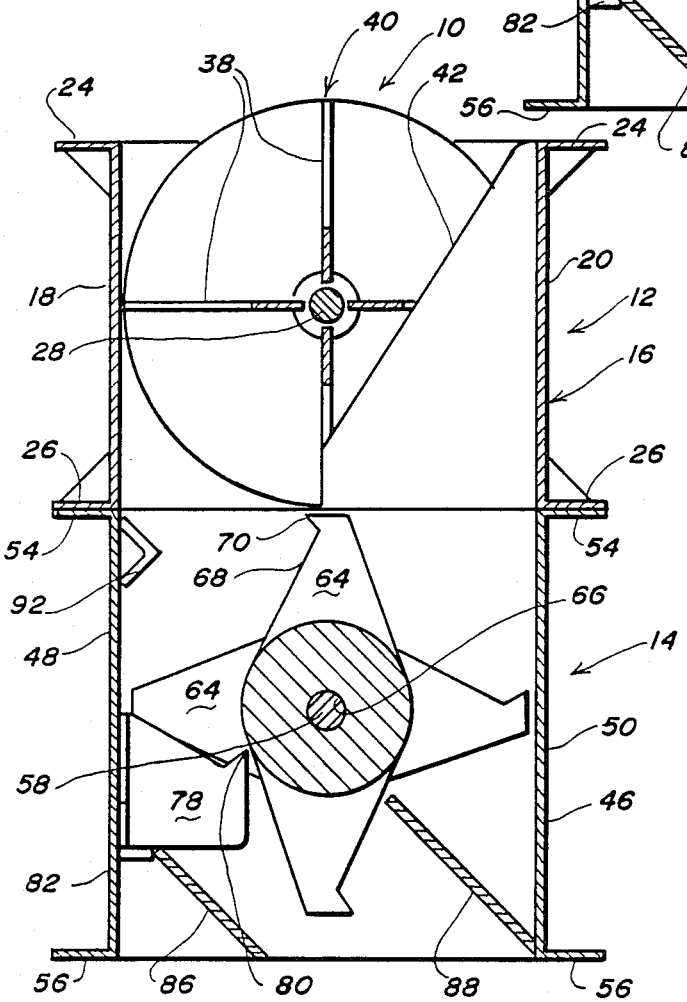
FIG. 4 is taken along line 4—4 in FIG. 2.
Figure 6:
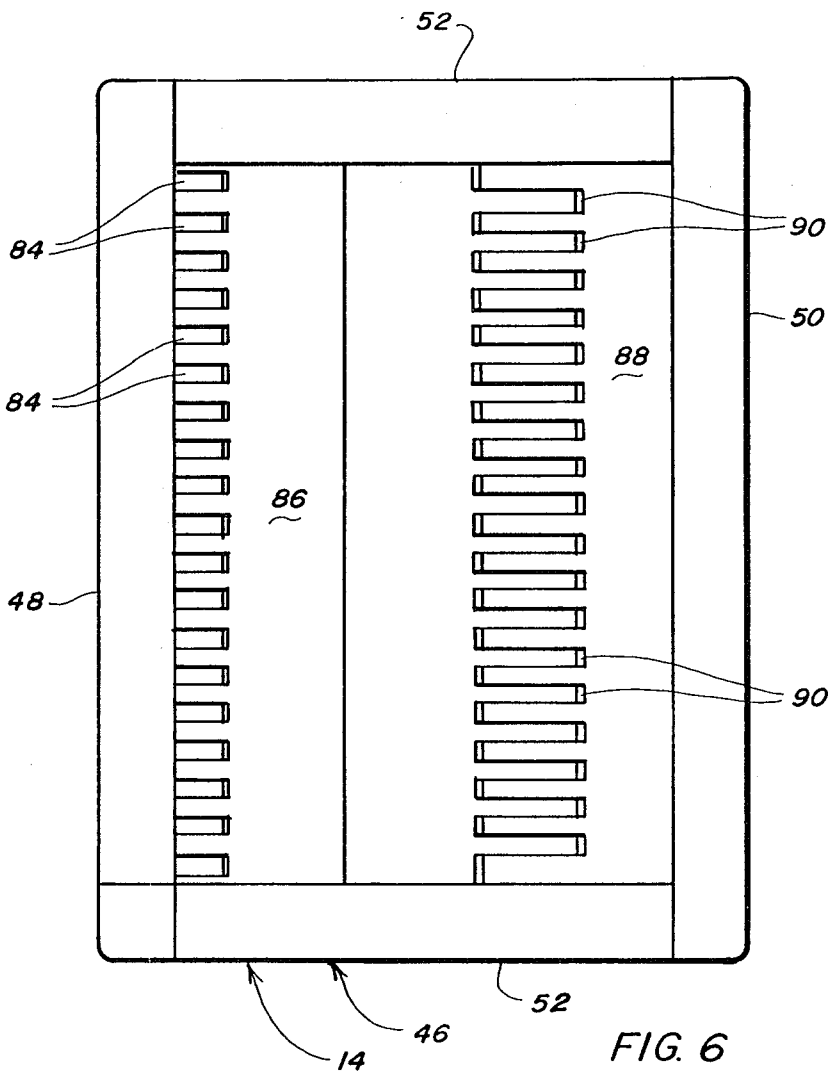
FIG. 6 is taken along line 6—6 in FIG. 1 with the stationary shredder elements removed for clarity.
Figure 5:
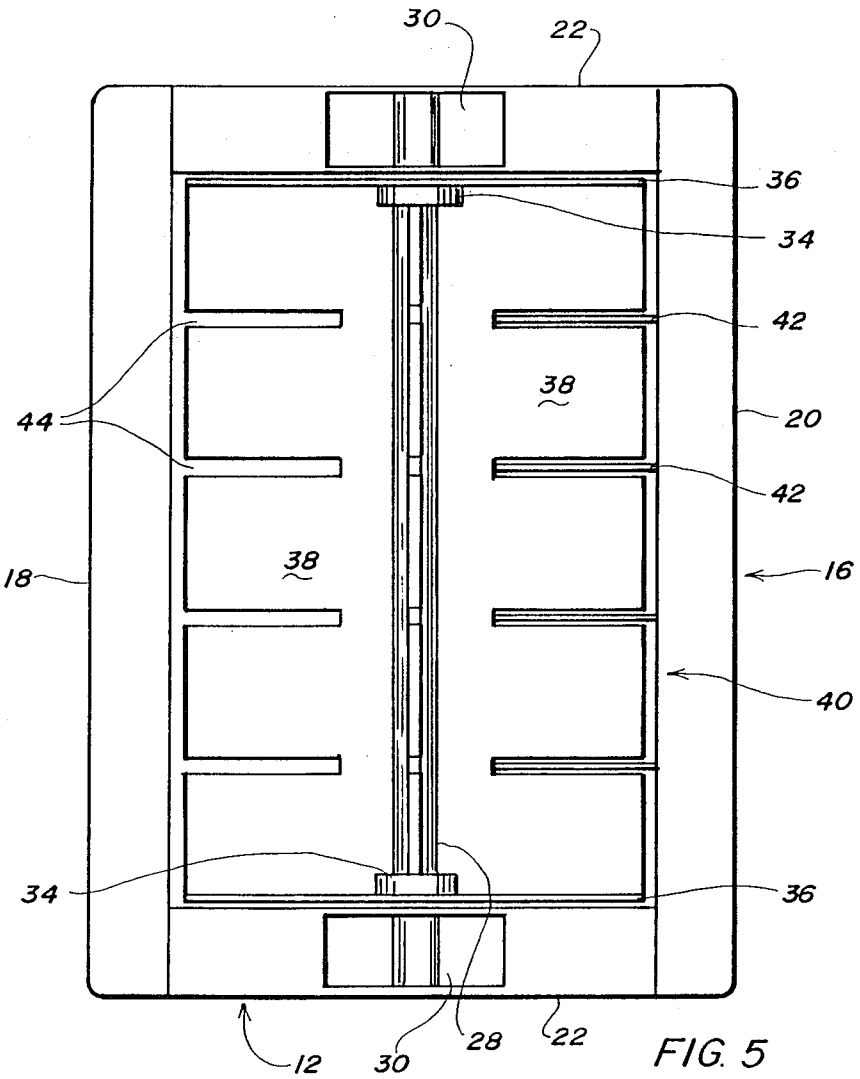
FIG. 5 is taken along line 5—5 in FIG. 1; 15

As best seen in FIGS. 3 and 4, a plurality of vertically disposed and spaced apart scraper blades 42 are attached to the inside of rear panel 20. Correspondingly spaced apart and aligned slots 44 are provided in vanes 38 such that blades 42 pass therethrough dislodging any containers that may become wedged in the pocket formed between adjacent vanes 38. To this end, blades 42 are preferably generally right triangular in profile as shown with their sides attached to rear panel 20 and base adjacent the outlet of the feeder. As shaft 28 turns in a counterclockwise direction as viewed in FIGS. 3 and 4, dislodged containers are moved by gravity down the hypotenuse of scraper blades 42 in the direction of front panel 18 and are pulled into shredder 14.

Shredder 14, like feeder 12, comprises an enclosure 46 which is open at its upper and lower ends to provide an inlet for receiving containers delivered by feeder 12 and an outlet for delivering the densified material into a suitable receptacle (not shown). As illustrated in the drawings, enclosure 46 includes a front and rear panel, 48 and 50, respectively, joined by side panels 52. Outwardly projecting top and bottom flanges 54 and 56 are provided on enclosure 46 for attachment to the outlet end of feeder 12 and to a support base (not shown), respectively.

A rotatable shaft 58 is rotatably journaled in bearing blocks 60 which are supported by side panels 52. Shaft 58 spans enclosure 46 and extends through side panels 52. The driving end of shaft 58 is attached to a motor typically mounted on the same support base (not shown) as shredder 14. The driven end of shaft 58 is keyed to a small pulley 62 for use as described hereinafter.

Keyed on shaft 58 is a plurality of rotary shredder elements 64, each of which includes a central hub 66 from which extends a knife 68. In a preferred form, knives 68 are provided in oppositely extending pairs and are spaced substantially 180 degrees apart. They are provisioned with a generally radially extending cutting edge that slopes in a direction opposite of rotation and terminates in a radially extending sharpened outer tip or toe 70 which projects in the direction of rotation of the knives. As illustrated, knives 68 are angularly spaced about shaft 58, preferably at 90 degrees to each other, such that as shaft 58 rotates every other rotary shredder element makes a hit with the anvil as more particularly described hereinafter. This avoids unproductive side load on shaft 58 requiring heavier duty bearing blocks 60. The arrangement is also preferred because each container is impacted by multiple knives 68 checking it from flipping about and emerging in pieces insufficiently chopped.

Spacer disks 72 separate rotary shredder elements 64 and smaller spacer disks 74 are provided at opposite ends of shaft 58 to accommodate a locknut 76 holding the assembled spacer disks and rotary shredder elements on the shaft. Spacer disks 72 and 74 have a diameter sufficient to fill the space between shaft 58 and the cutting circle of rotary shredder elements 64 to prevent material from wedging between them.

Figure 8:
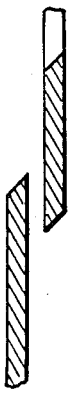
FIG. 8 is taken along line 8—8 in FIG. 7.
Figure 7:
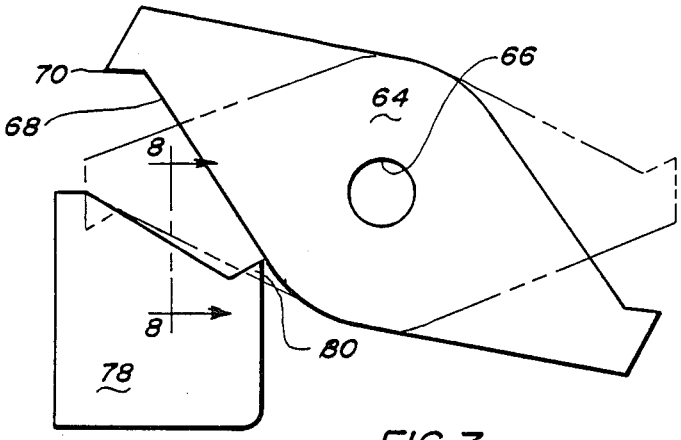
FIG. 7 is an enlargement showing details of the rotary and stationary shredder elements.

An anvil is formed of a plurality of stationary shredder elements 78 spaced apart a distance from one another slightly greater than the thickness of rotary shredder elements 64 which pass between them in fairly close tolerance to provide a cooperative cutting action. Each of stationary shredder elements 78 is formed as a knife with a generally transversely extending cutting edge that slopes in a direction opposite of rotation of rotary knives 68 and terminates in a generally transversely extending sharpened outer tip or toe 80 which projects in the direction opposite to the rotation of knives 68. As best seen in FIG. 7, the cutting face of stationary shredder elements 78 starts on centerline of shaft 58 and is sloped downward at an angle which intersects the cutting circle of rotary shredder elements 64. As shown in FIG. 8, rotary and stationary shredder elements 64 and 78 are beveled at about 45 degrees to provide a sharpened cutting edge enhancing cutting by providing a scissoring action as the containers being shredded are swept along the sharpened edges.

Stationary shredder elements 78 are attached to the inside of front panel 48 and are seated on a horizontal ledge 82 in slots 84 of an inwardly and downwardly flared guide plate 86. The upper end of guide plate 86 and horizontal ledge 82 re also attached to the inside of front panel 48. In addition to providing a seat for stationary shredder elements 78, guide plate 86 directs shredded material out of the machine and serves as an auxiliary anvil for anything left on rotary shredder elements 64.

A scraper plate 88 is attached to rear panel 50 adjacent the outlet of enclosure 46. As shown in FIGS. 3 and 4, scraper plate 88 is inclined at an angle generally parallel guide plate 86 and includes a plurality of slots 90 which are correspondingly spaced part and aligned with rotary shredder elements 64 such that knives 68 pass therethrough and are cleaned of any material which might be caught thereon. A deflector plate 92 is attached to front panel 48 near the inlet of enclosure 46 and provides means for directing the material being fed into the shredder into the path of knives 68.

A countershaft 94 is mounted to front panel 18 of feeder 12 with a large pulley 96 keyed to its driven end and a small pulley 98 keyed to its driving end. A chain drive 100 connects pulley 32 on shaft 28 with pulley 98 and a second chain drive 102 connects pulley 96 with pulley 62 on shaft 58. This arrangement permits feeder 12 to operate at a greatly reduced speed but in sync with shredder 14 and to be driven by a common motor.

Machine 10 can be used to densify plastic containers and can be used to advantage on difficult to shred items such as recyclable PET bottles. Such bottles are used for packaging carbonated beverages and typically come in 1-, 2- and 3-liter or gallon sizes. In order to withstand the demands made on such containers, the base is made of one plastic and the balance of the container from another.

In some states having deposit laws, the distributor is required to pick up the PET bottles and dispose of them. The bottles are not easily baled because some of the empty bottles are capped and the uncompacted bottles are unwieldy to transport. The present machine is sufficiently compact and inexpensive that it can be provided at the point of collection. It is also useful as a pre-shredder in a granulator operation and in general for shredding plastic containers.

In use, plastic containers individually or bagged in plastic are fed into the inlet of feeder 12 and fall in the pockets formed between adjacent vanes 38. As shaft 28 rotates in a counterclockwise direction as viewed in the drawings, the containers are swept along the inside of front panel 18 and are delivered into the outlet of feeder 12 where they fall by force of gravity into the inlet of shredder 14. Because the plastic containers have a high volume to weight ratio, they must be forcibly confined in the shredding zone otherwise a portion of them will be ejected back into the feeder by the windage of the shredder or by impact with rotary shredder elements 64. This is accomplished by vanes 38 which block their return. Any containers stuck in the pocket formed between vanes 38 are ejected by scraper blades 42 which direct them towards the inlet of shredder 14.

The plastic containers delivered by feeder 12 are deflected into the shredding zone by deflector plate 92 and are swept by rotary shredder elements 64 into stationary shredder elements 78. Each plastic container is hit by multiple knives, tips 70 of which start the tear, and is scissored by cooperative action between the sloped cutting surfaces of the stationary and rotary shredder elements 64 and 78. Pieces of container large enough to bridge one or more stationary shredder elements 78 are retained by tips 80 for a further hit by rotary shredder elements 64. Shreddings small enough to pass between stationary shredder elements 78 fall by force of gravity into the outlet of the shredder and into a receptacle for recycling or for disposal. Any material sticking to rotary shredder elements 64 is removed by scraper plates 88 and also falls into the outlet of the shredder.

In view of the above, it will be seen that the objects of the invention are achieved and other advantageous results attained. As various changes could be made in the above constructions without departing form the scope of the invention, it is intended that all matter contained in the above description or shown in the accompanying drawings shall be interpreted as illustrative and not in a limiting sense.

What is claimed is:

1. A machine for densifying plastic containers and the like comprising a feeder and a shredder, said feeder including an enclosure having a front panel, rear panel and side panels and an inlet and an outlet with a rotatable shaft rotatably journaled in the side panels between the inlet and the outlet, a paddle wheel mounted on the rotatable shaft with radial vanes having a length and width sufficient to effectively block the return of material from the shredder between the paddle wheel and the enclosure and having a plurality of radial slots at the tip of the radial vanes, a plurality of scraper blades attached to the interior of the rear panel correspondingly spaced apart and aligned with the slots in the radial vanes such that the scraper blades pass through the radial vanes as they are rotated upwards towards the rear panel; and said shredder including an enclosure having a front panel, rear panel and side panels and an inlet and an outlet with a shredder shaft rotatably journaled in the side panels between the inlet and the outlet, a plurality of rotary shredder elements mounted on the shredder shaft in spaced apart relationship on the shaft, each of which includes a rotary knife with a generally radially extending cutting edge that slopes in a direction opposite of rotation of said knife, a plurality of stationary shredder elements mounted on the inside of the front panel in spaced apart relationship, each of which includes a stationary knife with a generally transversely extending cutting edge that slopes in the direction of rotation of the rotary knives and intersects the cutting circle of the rotary knives, said stationary knives aligned such that the rotary knives pass between them to provide a cooperative scissoring action, and a scraper plate mounted on the rear panel adjacent the outlet of the enclosure and inclined upward towards the shredder shaft and inwards towards the front panel, said scraper plate including a plurality of slots that are correspondingly spaced apart and aligned with rotary knives such that the rotary knives pass therethrough and are cleaned of any material which might be caught thereon; and, wherein the front and rear panels of the feeder and shredder are oriented in the same direction and the outlet of the feeder is attached to the inlet of the shredder.

2. The machine of claim 1 wherein each rotary knife terminates in a generally radially extending sharpened outer tip which projects in the direction of rotation of the knife and each stationary knife terminates in a generally transversely extending sharpened outer tip which projects in a direction opposite of rotation of the rotary knives.

3. The machine of claim 2 wherein in the feeder the scraper blades are generally right triangular in profile, said blades attached to the interior of the rear panel by their side and having their base adjacent the outlet of the feeder and extending transversely substantially to the midline of the rotatable shaft.

4. The machine of claim 3 wherein the rotatable shaft of the feeder is powered by the same motor which powers the rotatable shaft of the shredder.

5. The machine of claim 2 wherein in the shredder the cutting edge of the stationary knives starts on centerline of the rotatable shaft of the shredder.

6. The machine of claim 5 wherein the rotary knives are seated in slots in the upper end of a guide plate mounted on the front panel of the shredder and inclined downwards towards the outlet and inwards towards the rear panel.

7. The machine of claim 6 wherein means are mounted on the inside of the front panel of the shredder adjacent the inlet for deflecting the material fed into the shredder into the path of the rotary knives.

* * * * *